US010473344B2

(12) United States Patent
Puranen et al.

(10) Patent No.: US 10,473,344 B2
(45) Date of Patent: Nov. 12, 2019

(54) ELECTRIC RE-HEAT DEHUMIDIFICATION

(75) Inventors: Chris Puranen, Noblesville, IN (US); Rajendra K. Shah, Indianapolis, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 714 days.

(21) Appl. No.: 14/003,688

(22) PCT Filed: Mar. 8, 2012

(86) PCT No.: PCT/US2012/028165

§ 371 (c)(1), (2), (4) Date: Sep. 6, 2013

(87) PCT Pub. No.: WO2012/122323

PCT Pub. Date: Sep. 13, 2012

(65) Prior Publication Data

US 2013/0340448 A1 Dec. 26, 2013

Related U.S. Application Data

(60) Provisional application No. 61/451,316, filed on Mar. 10, 2011.

(51) Int. Cl.
*F24F 3/153* (2006.01)
*F24F 3/14* (2006.01)

(52) U.S. Cl.
CPC ..... *F24F 3/153* (2013.01); *F24F 2003/1446* (2013.01); *F24F 2221/34* (2013.01)

(58) Field of Classification Search
CPC ..... F24F 2221/34; F24F 3/53; F24F 11/00151
(Continued)

(56) References Cited

U.S. PATENT DOCUMENTS 3,547,348 A * 12/1970 Kruper ..... G05D 22/02 165/225
3,798,920 A 3/1974 Morgan
(Continued)

FOREIGN PATENT DOCUMENTS

JP 56012945 A 2/1981
JP H02161266 A 6/1990
KR 20010056393 A 7/2001

OTHER PUBLICATIONS

International Search Report dated Jun. 11, 2012, for PCT/US12/028165 filed Mar. 8, 2012, pp. 1-4.
(Continued)

*Primary Examiner* — Jianying C Atkisson
*Assistant Examiner* — Meraj A Shaikh
(74) *Attorney, Agent, or Firm* — Cantor Colburn LLP

(57) ABSTRACT

An electric re-heat dehumidification apparatus to dehumidify a conditioned space is provided and includes a conditioning unit to produce an output airstream including overcooled air to be provided to the conditioned space to overcool the conditioned space during the dehumidifying of the conditioned space, a resistive element disposed within an output airstream of the conditioning unit, which, when activated, heats the overcooled air of the output airstream and a controller, operably coupled to the resistive element, to activate the resistive element in accordance with information of the conditioning unit, the resistive element and a temperature of the conditioned space to limit the overcooling of the conditioned space.

13 Claims, 3 Drawing Sheets

(58) Field of Classification Search
USPC ..... 236/44 R, 44 A, 44 C; 62/176.6
See application file for complete search history.

(56) References Cited

U.S. PATENT DOCUMENTS

| | | | | |
|---|---|---|---|---|
| 3,831,663 | A * | 8/1974 | Pithie | F24F 1/02 165/263 |
| 4,806,833 | A | 2/1989 | Young | |
| 4,813,474 | A * | 3/1989 | Umezu | F24F 11/08 165/228 |
| 5,177,972 | A | 1/1993 | Sillato | |
| 5,341,650 | A | 8/1994 | Nagasawa et al. | |
| 5,622,057 | A | 4/1997 | Bussjager et al. | |
| 5,678,417 | A | 10/1997 | Nigo et al. | |
| 6,070,110 | A | 5/2000 | Shah et al. | |
| 6,591,902 | B1 | 7/2003 | Trent | |
| 6,658,874 | B1 | 12/2003 | Trent | |
| 7,104,082 | B1 | 9/2006 | Moratalla | |
| 7,740,184 | B2 | 6/2010 | Schnell et al. | |
| 7,845,185 | B2 | 12/2010 | Knight et al. | |
| 8,325,144 | B1 | 12/2012 | Tierling et al. | |
| 8,544,288 | B2 | 10/2013 | MacDonald | |
| 2006/0225444 | A1 | 10/2006 | Taras et al. | |
| 2006/0273183 | A1* | 12/2006 | Cavanagh | F24F 3/153 236/44 C |
| 2007/0101737 | A1 | 5/2007 | Akei et al. | |
| 2008/0078842 | A1* | 4/2008 | MacDonald | F24F 3/1405 236/44 R |
| 2008/0156891 | A1 | 7/2008 | Zhou et al. | |
| 2009/0229286 | A1 | 9/2009 | Ellis et al. | |
| 2010/0070092 | A1 | 3/2010 | Winter et al. | |
| 2010/0107674 | A1 | 5/2010 | Aono | |
| 2010/0229579 | A1 | 9/2010 | Knight et al. | |

OTHER PUBLICATIONS

Written Opinion dated Jun. 11, 2012, for PCT/US12/028165 filed Mar. 8, 2012, pp. 1-6.

International Preliminary Report on Patentability dated Sep. 10, 2013 in PCT Application No. PCT/2012/028165 filed Mar. 8, 2012; pp. 1-6.

* cited by examiner

ELECTRIC RE-HEAT DEHUMIDIFICATION

CROSS REFERENCE TO RELATED APPLICATION

This application is a National Stage Application of PCT Application No. PCT/US12/28165 filed Mar. 8, 2012, which is a PCT Application of U.S. Provisional Patent Application No. 61/451316 filed Mar. 10, 2011, the disclosures of which are incorporated by reference herein in their entireties.

BACKGROUND OF THE INVENTION

The subject matter disclosed herein relates to electric re-heat dehumidification and, more particularly, to an electric re-heat dehumidification apparatus.

Heating, Ventilation and Air Conditioning (HVAC) systems enhance dehumidification in high humidity climates by removing moisture from indoor air even during cool night periods and the spring/fall shoulder seasons when high indoor humidity levels are coupled with moderate cooling loads. In these situations, since indoor temperatures remain at comfortable levels most of the time, typical thermostat based systems operate in the air conditioning mode for limited, if any, periods of time. Indoor humidity levels, therefore, remain uncontrolled and often become excessive, to the detriment of comfort and indoor air quality.

To address this issue, modern systems operate air conditioners just to control high humidity while allowing for a limited degree of overcooling and/or reduce indoor air flow in a controlled manner to maximize moisture removal while limiting overcooling. In this manner, modern systems have proved effective in maintaining humidity at desirable levels under most conditions. However, in the most challenging situations and climates, further enhancements are necessary and, in one approach, air-conditioned air is re-heated to minimize or cancel the overcooling effect. The air conditioner may then be run as long as necessary to bring humidity down to a desirable level without fear of overcooling.

BRIEF DESCRIPTION OF THE INVENTION

According to one aspect of the invention, an electric re-heat dehumidification apparatus to dehumidify a conditioned space is provided and includes a conditioning unit to produce an output airstream including overcooled air to be provided to the conditioned space to overcool the conditioned space during the dehumidifying of the conditioned space, a resistive element disposed within an output airstream of the conditioning unit, which, when activated, heats the overcooled air of the output airstream and a controller, operably coupled to the resistive element, to activate the resistive element in accordance with information of the conditioning unit, the resistive element and a temperature of the conditioned space to limit the overcooling of the conditioned space.

According to another aspect of the invention, an electric re-heat dehumidification apparatus to dehumidify a conditioned space is provided and includes a conditioning unit to produce an output airstream including overcooled air to be provided to the conditioned space to overcool the conditioned space during the dehumidifying of the conditioned space, a user interface by which an occupant of the conditioned space inputs commands governing conditioning unit operation, a resistive element disposed within an output airstream of the conditioning unit, which, when activated, heats the overcooled air of the output airstream and a controller, operably coupled to the resistive element, to activate the resistive element in accordance with the input commands, information of the conditioning unit and the resistive element and a temperature of the conditioned space to limit the overcooling of the conditioned space.

According to yet another aspect of the invention, a method of performing electric re-heat dehumidification of a conditioned space is provided and includes activating a resistive element disposed in an output airstream of a conditioning unit operated to overcool air to be provided to the conditioned space to overcool the conditioned space during a dehumidification process, the activating being conducted to limit the overcooling of the conditioned space in accordance with cooling and heating capacities of the conditioning unit and the resistive element, respectively, and a temperature of the conditioned space.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
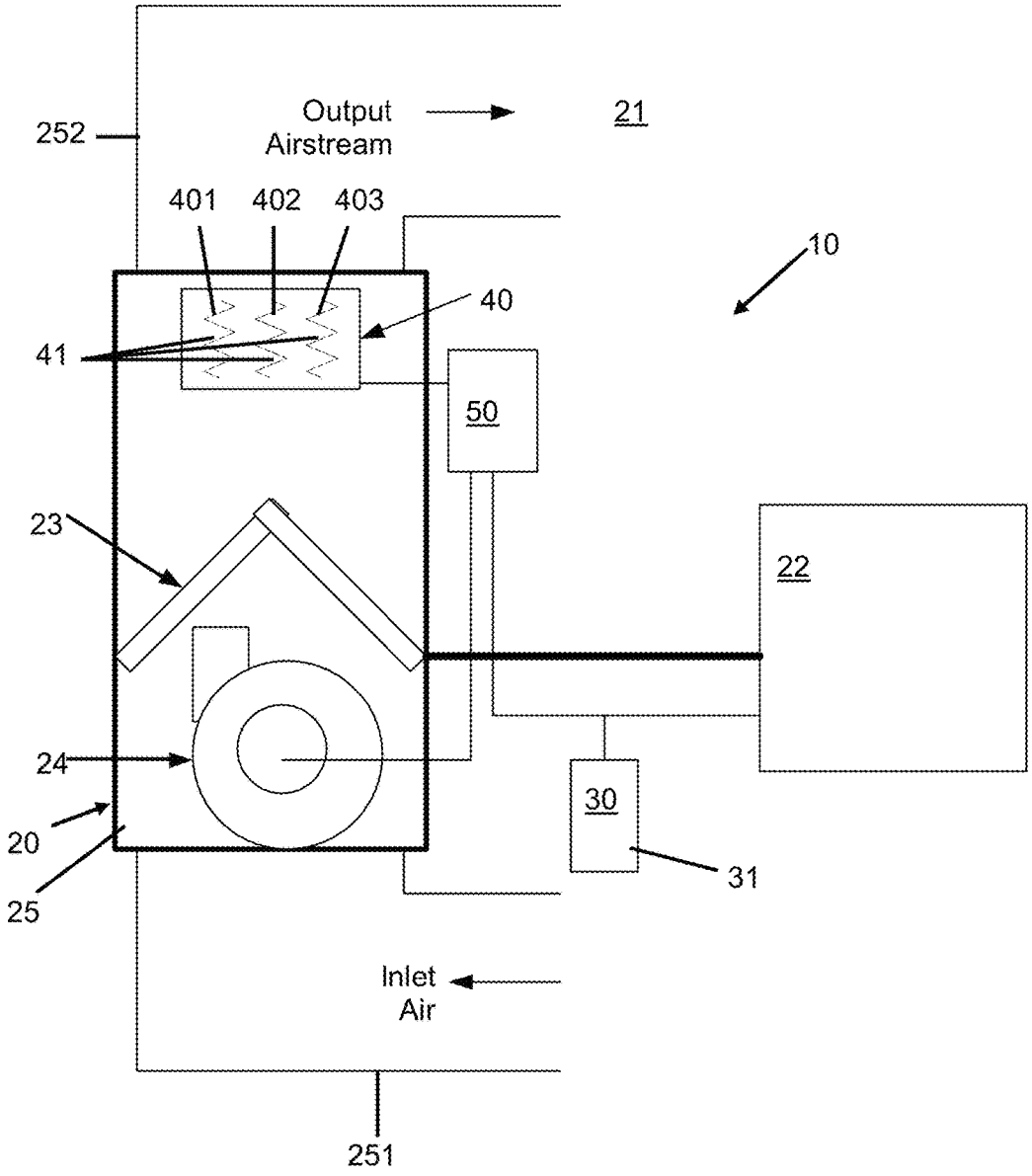
FIG. 1 is a schematic illustration of an electric re-heat dehumidification apparatus.

With reference to FIG. 1, an electric re-heat dehumidification apparatus 10 is provided. The apparatus 10 includes a conditioning unit 20, a user interface 30, a resistive element 40 and a controller 50. The conditioning unit 20 may be a wall unit air conditioner, a central air conditioning unit, a heat pump or an HVAC system and is configured to provide conditioned air to a conditioned space 21, which may be an enclosed space. In some cases, this conditioned air serves to overcool the conditioned space 21 during a dehumidification process. The user interface 30 is operably coupled to the conditioning unit 20 and may be a thermostat that is accessible to an occupant of the conditioned space 21. The user interface 30 may therefore be used by the occupant to input commands governing operation of the conditioning unit 20. The resistive element 40 is disposed within or proximate to an output airstream of the conditioning unit 20 and, when activated, heats the output airstream. The controller 50 is operably coupled to at least the resistive element 40 and is configured to activate the resistive element 40 to thereby heat overcooled air of the output airstream in order to limit the overcooling of the conditioned space 21 in accordance with at least the input commands, information of or relating to the conditioning unit 20 and the resistive element 40 and a temperature of the conditioned space 21.

In accordance with embodiments and, as shown in FIG. 1, the conditioning unit 20 includes a compressor 22 to compress inlet air, an evaporator 23 to cool the inlet air, a blower 24 to blow the inlet air over coils of the evaporator 23 and a housing 25 to house at least the evaporator 23 and the blower 24. In addition, inlet and outlet ducts 251, 252 may be coupled to opposing upstream and downstream ends of the housing 25, respectively. The inlet air may be thus drawn into the conditioning unit 20 via the inlet duct 251 from the conditioned space 21 or from another source and the output airstream flows out of the conditioning unit 20 and into the conditioned space 21 via the outlet duct 252.

The resistive element 40 may be disposed proximate to the downstream end of the housing 25 and may include a fan coil 41, which is supported at a wall of the housing 25 such that the resistive element 40 is disposed within the output airstream. Further, the resistive element 40 may include 2, 3 or more self-identifying electric heating stages 401, 402, 403 (for purposes of clarity and brevity, three stages will be described). As will be discussed below, each of the heating stages 401, 402, 403 has a heating capacity that is known to the controller 50 by the self-identification of the stages themselves or by other identification processes. The controller 50 can therefore activate the appropriate heating stage in accordance with the current operating capacity of the conditioning unit 20 and, in some cases, additional factors, such as the desired and actual temperatures, the desired humidity and/or the actual humidity of the conditioned space 21.

As mentioned above, the user interface 30 may include a thermostat that is accessible to an occupant of the conditioned space. The user interface 30 may further include sensing equipment 31 to sense one or more of the temperature and a humidity of the conditioned space 21. The sensing equipment 31 may be housed within the housing of the user interface 30 or may be remote from the user interface 30, in which case, the sensing equipment 31 may be singular or plural and may be arrayed around the conditioned space 21.

The controller 50 may be incorporated within the user interface 30 or separate from the user interface 30. In either case, the controller 50 may be any computing device having a memory unit and a processor operably coupled to the memory unit. In this way, executable instructions stored in the memory unit can, when executed, cause the processor to operate as described herein.

The information of or relating to the conditioning unit 20 and the resistive element 40 may include first and second data that is accessible to and/or stored within, for example, a memory unit of the user interface 30 or the memory unit of the controller 50. In any case, the first data may be reflective of a cooling capacity of the conditioning unit 20 and the second data may be reflective of a heating capacity of each of the heating stages 401, 402, 403 of the resistive element 40, respectively. As such, with the controller 50 coupled to the resistive element and possibly further coupled to the conditioning unit 20 and the user interface 30, the controller 50 may activate the heat stages 401, 402, 403 of the resistive element 40 alone and/or in combination with one another to meet an overcooling demand of the conditioning unit 20. In addition, the controller 50 may run the conditioning unit 20 at low and high capacities for dehumidification with the resistive element 40 activated. Still further, where the conditioning unit 20 may be run with multiple or variable cooling capacities, the controller 50 may run the conditioning unit 20 at a cooling capacity that matches the heating capacity of the resistive element 40.

Figure 2:
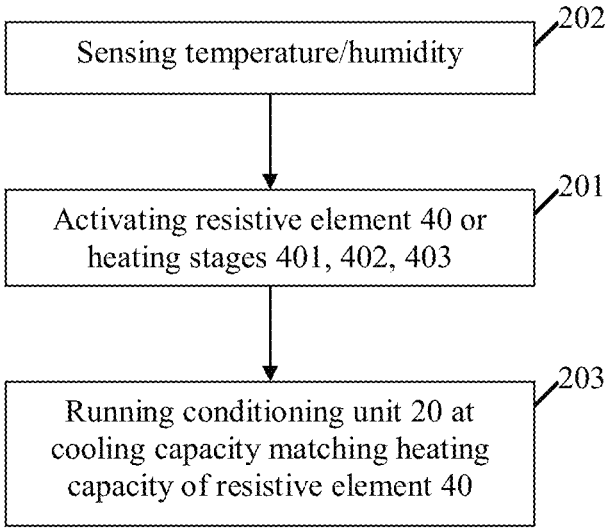
FIG. 2 is a flow diagram illustrating an operation of the electric re-heat dehumidification apparatus of FIG. 1.

With reference to FIG. 2, a method of performing electric re-heat dehumidification of a conditioned space 21 is provided. The method includes activating a resistive element 40, or heating stages 401, 402, 403 thereof alone and/or in combination with one another, which is disposed in an output airstream of a conditioning unit 20 that is operated to overcool air to be provided to the conditioned space 21 to overcool the conditioned space during a dehumidification process (operation 201). Here, the activating of operation 201 may be conducted in order to limit the overcooling of the conditioned space 21 during the dehumidification process in accordance with at least cooling and heating capacities of the conditioning unit 20 and the resistive element 40, respectively, and a temperature of the conditioned space 21.

The method may further include sensing a temperature and a humidity of the conditioned space 21 to which the airstream is output (operation 202), with the activating of operation 201 being further conducted in accordance with the sensed temperature and humidity. The method may further include running the conditioning unit 20 at a cooling capacity matching the heating capacity of the resistive element 40 (operation 203).

Figure 3:
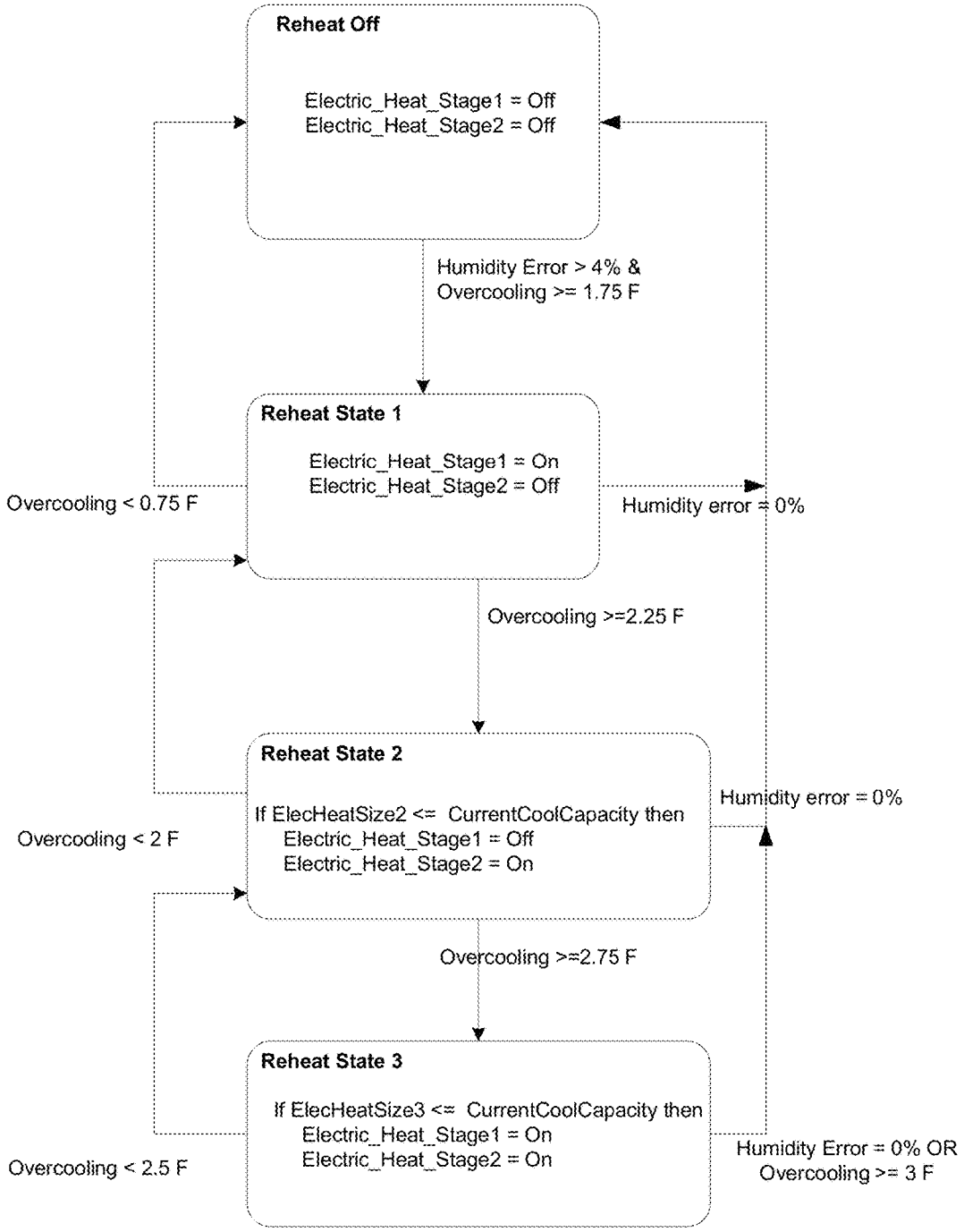
FIG. 3 is a state diagram that illustrates a further operation of the electric re-heat dehumidification apparatus of FIG. 1.

With reference to FIG. 3, with the cooling capacity of the conditioning unit 20 and the heating capacity of the resistive element known, a maximum number of the heating stages 401, 402, 403 that is/are to be used during electric re-heat can be determined. In addition, it may be determined whether or not it is necessary to run the conditioning unit 20 at lower, intermediate or higher capacities for dehumidification (normally dehumidification is done at the lowest capacity). Generally, the main priority would be to avoid having conditioned air delivered to the conditioned space 21 at a significantly warmer temperature than the desired room temperature during dehumidification processes.

Dehumidification operations occur when cooling temperature set point(s) are satisfied but cooling humidity set point(s) are not satisfied. The dehumidification algorithm, including overcooling compensated humidity targets, remains in effect for both zoned and unzoned systems with indoor air flow (i.e., the air flow being provided to the conditioned space 21) limited. Depending on the extent of overcooling, one or more heating stages 401, 402, 403 of the resistive element 40 may be turned on up to the maximum number as determined below. Also, a multiple or variable capacity conditioning unit 20 may be switched to a higher capacity when electric re-heating is turned on.

In an example, an amount of overcooling (in degrees) may be calculated to be equal to half of a humidity error value, which can be clamped between 0 and 3, with electric re-heat not being used for humidity errors less than 4%. Under this condition, the conditioning unit 20 should be able to remove humidity on its own. With this in mind, as shown in FIG. 3, with overcooling being less than 0.75 degrees Fahrenheit, all heating stages 401, 402, 403 may be turned off, with overcooling being less than 1.75 degrees Fahrenheit and a humidity error greater than 4%, a first heating stage 401 may be turned on.

If the overcooling exceeds 2.25 degrees Fahrenheit and it is determined that the cooling capacity of the conditioning unit 20 approaches the heating capacity of a second heating stage 402, the first heating stage 401 may be turned off and the second heating stage 402 may be turned on as long as the overcooling stays above 2 degrees Fahrenheit. Similarly, if the overcooling exceeds 2.75 degrees Fahrenheit and it is determined that the cooling capacity of the conditioning unit 20 approaches the heating capacity of a third heating stage 403, the first and second heating stages 401 and 402 may both be turned on as long as the overcooling stays above 2.5 degrees Fahrenheit.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electric re-heat dehumidification apparatus to dehumidify a conditioned space, comprising:

a conditioning unit to produce an output airstream including overcooled air to be provided to the conditioned space to overcool the conditioned space during the dehumidifying of the conditioned space;

a user interface by which an occupant of the conditioned space inputs commands governing conditioning unit operation;

a resistive element disposed within an output airstream of the conditioning unit, the resistive element comprising first, second and third stages that, when activated, heat the overcooled air of the output airstream; and a controller to limit the overcooling of the conditioned space, the controller being operably coupled to the resistive element and configured to:

concurrently activate a combination of the first, second and third stages of the resistive element in accordance with the input commands, information of the conditioning unit and the stages of the resistive element and a temperature of the conditioned space, and activate the first, second and third stages of the resistive element in sequence with a first, second or third stage deactivation and repeated activation in accordance with the input commands, information of the conditioning unit and the stages of the resistive element and a temperature of the conditioned space.

2. The electric re-heat dehumidification apparatus according to claim 1, wherein the conditioning unit comprises:

an evaporator to cool inlet air;

a blower to blow the inlet air over the evaporator;

a housing to house at least the evaporator and the blower;

an inlet duct coupled to an upstream end of the housing and through which the inlet air is drawn into the conditioning unit; and an outlet duct coupled to a downstream end of the housing and through which the output airstream flows from the conditioning unit into the conditioned space.

3. The electric re-heat dehumidification apparatus according to claim 2, wherein the resistive element comprises a fan coil supported at the housing.

4. The electric re-heat dehumidification apparatus according to claim 1, wherein the user interface comprises a thermostat.

5. The electric re-heat dehumidification apparatus according to claim 4, wherein the thermostat comprises sensing equipment to sense the temperature and a humidity of the conditioned space.

6. The electric re-heat dehumidification apparatus according to claim 1, wherein the information comprises first and second data reflective of a cooling capacity of the conditioning unit and a heating capacity of the stages of the resistive element.

7. The electric re-heat dehumidification apparatus according to claim 6, wherein the controller is operative in accordance with:

a first humidity error value exceeding a predefined threshold and first a degree of overcooling, and a second humidity error value and second degrees of overcooling.

8. The electric re-heat dehumidification apparatus according to claim 6, wherein the controller is operably coupled to the conditioning unit to run the conditioning unit at low and high capacities for the dehumidifying of the conditioned space with the resistive element activated.

9. The electric re-heat dehumidification apparatus according to claim 6, wherein the controller is operably coupled to the conditioning unit to run the conditioning unit at a cooling capacity matching the heating capacity.

10. A method of performing electric re-heat dehumidification of a conditioned space, comprising:

activating a low resistive element stage while maintaining intermediate and high resistive element stages in an off condition;

deactivating the low resistive element stage and activating the intermediate resistive element stage while maintaining the high resistive element stage in the off condition;

concurrently re-activating the low resistive element stage while maintaining the intermediate resistive element stage in an on condition and the high resistive element stage in on the off condition, the low, intermediate and high resistive element stages being disposed in an output airstream of a conditioning unit operated to overcool air to be provided to the conditioned space to overcool the conditioned space during a dehumidification process, the activating, the maintaining, the deactivating and the concurrent re-activating being conducted to limit the overcooling of the conditioned space in accordance with cooling and heating capacities of the conditioning unit and the low, intermediate and high resistive element stages, respectively, and a temperature of the conditioned space.

11. The method according to claim 10, wherein the activating, the maintaining, the deactivating and the concurrent re-activating is in accordance with:

a first humidity error value exceeding a predefined threshold and a first degree of overcooling, and a second humidity error value and second degrees of overcooling.

12. The method according to claim 10, further comprising sensing the temperature and a humidity of the conditioned space, the activating, the maintaining, the deactivating and the concurrent re-activating being further conducted in accordance with the sensed temperature and the sensed humidity.

13. The method according to claim 10, further comprising running the conditioning unit at a cooling capacity matching the heating capacity.

* * * * *